US010675678B2

(12) United States Patent
Tennant et al.

(10) Patent No.: US 10,675,678 B2
(45) Date of Patent: Jun. 9, 2020

(54) APPARATUS FOR CASTING MULTIPLE COMPONENTS USING A DIRECTIONAL SOLIDIFICATION PROCESS

(71) Applicant: ROLLS-ROYCE plc, London (GB)

(72) Inventors: Paul A Tennant, St Mary Church (GB); Kevin Goodwin, Ilkeston (GB)

(73) Assignee: ROLLS-ROYCE plc, London (GB)

( * ) Notice: Subject to any disclaimer, the term of this patent is extended or adjusted under 35 U.S.C. 154(b) by 163 days.

(21) Appl. No.: 15/399,438

(22) Filed: Jan. 5, 2017

(65) Prior Publication Data

US 2017/0216912 A1 Aug. 3, 2017

(30) Foreign Application Priority Data

Feb. 3, 2016 (GB) ..... 1601898.8

(51) Int. Cl.

| | |
|---|---|
| ***B22D 27/04*** | (2006.01) |
| ***B22D 25/02*** | (2006.01) |
| ***B22D 15/04*** | (2006.01) |
| ***B22D 41/00*** | (2006.01) |
| ***F01D 5/12*** | (2006.01) |
| ***F01D 9/02*** | (2006.01) |

(Continued)

(52) U.S. Cl.

CPC ..... *B22D 27/045* (2013.01); *B22D 15/04* (2013.01); *B22D 25/02* (2013.01); *B22D 41/00* (2013.01); *F01D 5/12* (2013.01); *F01D 9/02* (2013.01); *F01D 11/00* (2013.01); *F04D 29/083* (2013.01); *F04D 29/324* (2013.01); *F04D 29/542* (2013.01); *F05D 2220/32* (2013.01); *F05D 2230/20* (2013.01)

(58) Field of Classification Search

CPC ..... B22D 15/04; B22D 27/04; B22D 27/045; B22C 9/04; B22C 9/12

See application file for complete search history.

(56) References Cited

U.S. PATENT DOCUMENTS 3,680,625 A 8/1972 Hein et al.
4,062,399 A * 12/1977 Lirones ..... B22D 27/045 164/338.1

(Continued)

FOREIGN PATENT DOCUMENTS

EP 0034021 A1 * 8/1981 ..... B22D 27/045
EP 0 059 550 A2 9/1982
JP 2003-311390 A 11/2003

OTHER PUBLICATIONS

Sep. 12, 2016 Search Report issued in British Patent Application No. GB1601898.8.

(Continued)

*Primary Examiner* — Kevin E Yoon
*Assistant Examiner* — Jacky Yuen
(74) *Attorney, Agent, or Firm* — Oliff PLC

(57) ABSTRACT

An apparatus for the simultaneous casting of multiple components using a directional solidification process includes; a pouring cup arranged on a centerline, an array of moulds encircling the pouring cup and centre line, an array of feed channels extending from the pouring cup to a top end of each mould, and a heat deflector. The heat deflector comprises a wall arranged between the array of moulds and the centerline extending along the length of the moulds and in thermal contact with the moulds.

13 Claims, 2 Drawing Sheets

(51) Int. Cl.

| | |
|---|---|
| ***F01D 11/00*** | (2006.01) |
| ***F04D 29/08*** | (2006.01) |
| ***F04D 29/32*** | (2006.01) |
| ***F04D 29/54*** | (2006.01) |

(56) References Cited

U.S. PATENT DOCUMENTS

| | | | | |
|---|---|---|---|---|
| 4,609,029 | A | 9/1986 | Vishnevsky et al. | |
| 6,206,081 | B1 | 3/2001 | Chiang et al. | |
| 6,651,728 | B1 * | 11/2003 | Graham | B22D 27/04 164/122.1 |
| 7,152,659 | B2 * | 12/2006 | Boswell | B22D 27/045 164/361 |
| 2004/0163790 | A1 | 8/2004 | Boswell | |
| 2015/0027653 | A1 * | 1/2015 | Guerche | B22C 9/04 164/47 |
| 2015/0224568 | A1 | 8/2015 | Fargeas et al. | |

OTHER PUBLICATIONS

Jun. 19, 2017 Extended Search Report issued in European Patent Application No. 17150340.2.

* cited by examiner

APPARATUS FOR CASTING MULTIPLE COMPONENTS USING A DIRECTIONAL SOLIDIFICATION PROCESS

FIELD OF THE INVENTION

The present invention relates to component casting and more particularly but not exclusively to component casting of directional solidification of single crystal components for engines, such as blades, seal segments and nozzle guide vanes.

BACKGROUND OF THE INVENTION

It is known to use casting to produce a wide range of components with complex shapes that would be otherwise difficult or uneconomical to manufacture by other methods. Molten material is poured into a mould which defines the shape of the component. The material is then allowed to cool and solidify in the shape of the mould. Where the material has a melting point well above standard ambient temperature and pressure (SATP) (which is typical for most metals), the pouring of the molten material takes place within a furnace. It is known to control the cooling of the molten material in the mould to control the microstructure of the solidified material.

It is known to provide multiple components simultaneously by arranging a plurality of moulds in a single assembly. The moulds are connected by a tree-like network of casting channels through which molten material from a casting cup can be fed to the multiple moulds simultaneously. Once filled, the moulds are collectively drawn from the furnace in a controlled manner.

In, for example, turbine blades it is desirable to provide a single crystal component. This is achieved through a process of "directional solidification" wherein control is exerted over the nucleation and the growth of single crystals in a molten metal as it passes from its liquid state to a solid state. The purpose of such directional solidification is to avoid the negative effects of grain boundaries within the solidified component. One form of directional solidification is single crystal directional solidification ensuring that the part solidifies as a single crystal, so as to minimise the inclusion of grain boundaries, most especially high angle grain boundaries, in the solidified component.

Techniques for producing single crystal components are well known. One example is known as the Bridgman-Stockbarger technique. The mould may contain a seed crystal to initiate a single grain or crystal growth and is gradually withdrawn from the furnace in a direction opposite to that of the desired crystal growth such that the temperature gradient within the molten material is effectively controlled. As an alternative to a seed crystal, a grain selector may be used. The latter typically takes the form of a geometrically designed grain selector cavity at a bottom end of the mould. The shape of the grain selector cavity encourages monocrystalline growth and can be sacrificed in a machining operation subsequent to the casting process.

FIG. 1 shows in schematic a known apparatus for the simultaneous manufacture of multiple cast components using a directional solidification process. As shown in the Figure the apparatus comprises a pouring cup 1 into which molten material M is poured. A plurality of feed channels 2 extend radially around the centrally arranged cup 1 to a top end of the moulds 3. Molten material M poured into the cup 1 flows along the feed channels 2 and into the moulds 3. Each mould 3 is provided with a seed crystal 4 at a bottom end. Beneath the bottom end of the moulds 3 is a chill plate 5 which is maintained generally at a temperature below the melting point of the material M creating a temperature gradient from the bottom to the top of the moulds 3. The moulds are enclosed by a heat source 6 which encircles the cup 1 and mould 3 assembly. With the moulds filled, the assembly is drawn in a controlled manner out of the heat source in the direction of arrow A to ensure directional solidification from the bottom of the moulds 3 (where the seed crystal 4 is arranged) to the top of the moulds 3. The combination of a single crystal seed 4 with the controlled cooling encourages growth of a single crystal structure in the semi-molten casting.

For a component of uniform shape and cross section, consistent directional solidification is relatively simple to achieve, however, many components are non-uniform in shape and cross section and so provide differing radiation heat effects at various points throughout the solidifying component. Due to difficulties in controlling the temperature gradient throughout changes in the shape and cross section an unacceptable occurrence of defects in the solidified component can result.

Moulds for the described apparatus may be formed using the so called "lost wax" or "investment casting" method (though other methods may be used). In this method, a pattern of the desired component shape is formed from a wax or other material of low melting point. The wax pattern is coated in ceramic slurry which is subsequently dried and fired to form a ceramic shell around the wax pattern. The wax can then be heated and removed to provide a mould, the cavity of which defines the desired component shape.

US 2004/0163790A1 proposes the inclusion of "deflector elements" which comprise localised extensions of the mould adjacent to smaller cross-sections of the mould and are arranged substantially orthogonal to the direction of desired solidification. The deflectors may be coated with a heat emissive material and serve to deflect heat back to adjacent smaller cross-sections thereby slowing their rate of cooling to a rate which better matches the cooling rate in larger cross sections of the mould.

US 201510224568A1 proposes a disc-like heat shield which extends in a radial direction from centre fine of the apparatus and around each mould. The heat shield is thus arranged orthogonal to the desired direction of solidification which serves to preserve heat generally in the region of the moulds. For elongated moulds, US 2015/0224568A1 proposes multiple (two) such heat shields axially separated along the length of the moulds.

SUMMARY OF THE INVENTION

In accordance with the present invention there is provided an apparatus for the simultaneous casting of multiple components using a directional solidification process comprising;

a pouring cup, an array of moulds, an array of feed channels extending from the pouring cup to each mould, and a heat deflector, wherein the heat deflector comprises a wall arranged on an opposite side of the array of moulds to the heat source and extends lengthwise along the moulds and in thermal contact with the moulds.

In an option, the moulds may be arranged around a common centre and the heat deflector is arranged between the centre and the moulds, in other options, the moulds may be arranged in two rows and the heat deflector is arranged between the rows. The pouring cup may be arranged centrally of the array of moulds. The feed channels may be branched For example, the feed channels may include a down-feed and multiple branched channels extending from the down-feed into a mould. Optionally, the feed channels may terminate at a top end of the mould.

In one option, in use, a chili plate is arranged at a bottom end of the array of moulds, and a heat source surrounds the array of moulds. The apparatus and chill plate are configured with respect to the heat source such that, once the moulds have been filled, the apparatus and chill plate can be controllably withdrawn from the heat source in a direction opposite to a desired direction of solidification. It is to be understood that withdrawal might involve movement of the apparatus with respect to the heat source, or of the heat source relative to the apparatus. One or more baffles may be arranged between the chill plate and the bottoms of the moulds whereby to assist in maintaining a temperature gradient from the chill plate to the tops of the moulds.

Optionally the moulds include grain selector cavities at their bottom ends to assist in the initiation of single crystal formation within the mould.

For example, the heat deflector comprises a circumferential wall arranged around a centre of the array of moulds. In other embodiments the wall is multifaceted or has a varying cross section. The wall may be modular. Optionally, on a surface facing the moulds, the wall is provided with an array of local deflectors which are each shaped to follow the contour of a mould to which they are positioned adjacent. The local deflectors may be removably secured to the wall or may comprise an integral part of the wall. The local deflectors may individually comprise a number of baffles of varying shape arranged collectively to follow a contour of the mould. The heat deflector preferably extends substantially the entire length of the mould but may, for example, extend only across a significant extent of the length of the mould, for example along about 60% or greater, more preferably greater than 75% the heat deflector need not be a continuous wall, for example it may have a continuous surface only when in direct line with a mould, spaces being provided in the wall where it faces between moulds. The deflectors may be shaped in such a way that they, at least partly, wrap around the mould. For example, the deflector has a profiled face which curves and the mould sits within the curve.

The local deflectors need not have a shape which precisely matches with that of the mould. The local deflectors may be arranged such that the shape provided to follow the contour of a mould is axially offset with respect to the mould whereby to follow the thermal behaviour of material solidifying in the mould. It will be appreciated that thermal behaviour will typically lag behind the geometry of the mould, towards the cooler end of the thermal gradient.

The heat deflector and/or local deflectors may be formed during the manufacture of the moulds, for example being formed from a wax core coated in fired ceramic slurry. The heat deflector and/or local deflectors may be provided with a high emissive surface coating. For example the surface coating is a magnesium oxide paint. In other alternatives, the heat deflector and/or local deflectors may be built using an additive layer manufacturing method and/or manufactured with high temperature capable materials such as carbon or graphite The heat deflector may comprise attachment elements to which a range of local deflectors may be replaceably attached. This ensures that the heat deflector can be re-used on multiple occasions in the casting of components from differently shaped moulds. The heat deflectors need not be formed during the manufacture of the moulds.

For example, the moulds define the shape of turbine blades. Alternatively (and without limitation), the moulds define the shape of nozzle guide vanes, compressor blades or seal segments configured for use in a gas turbine engine.

BRIEF DESCRIPTION OF THE DRAWINGS

An embodiment of the invention is now described with reference to the accompanying Figures in which.

DETAILED DESCRIPTION OF DRAWINGS AND SOME EMBODIMENTS

Figure 1:
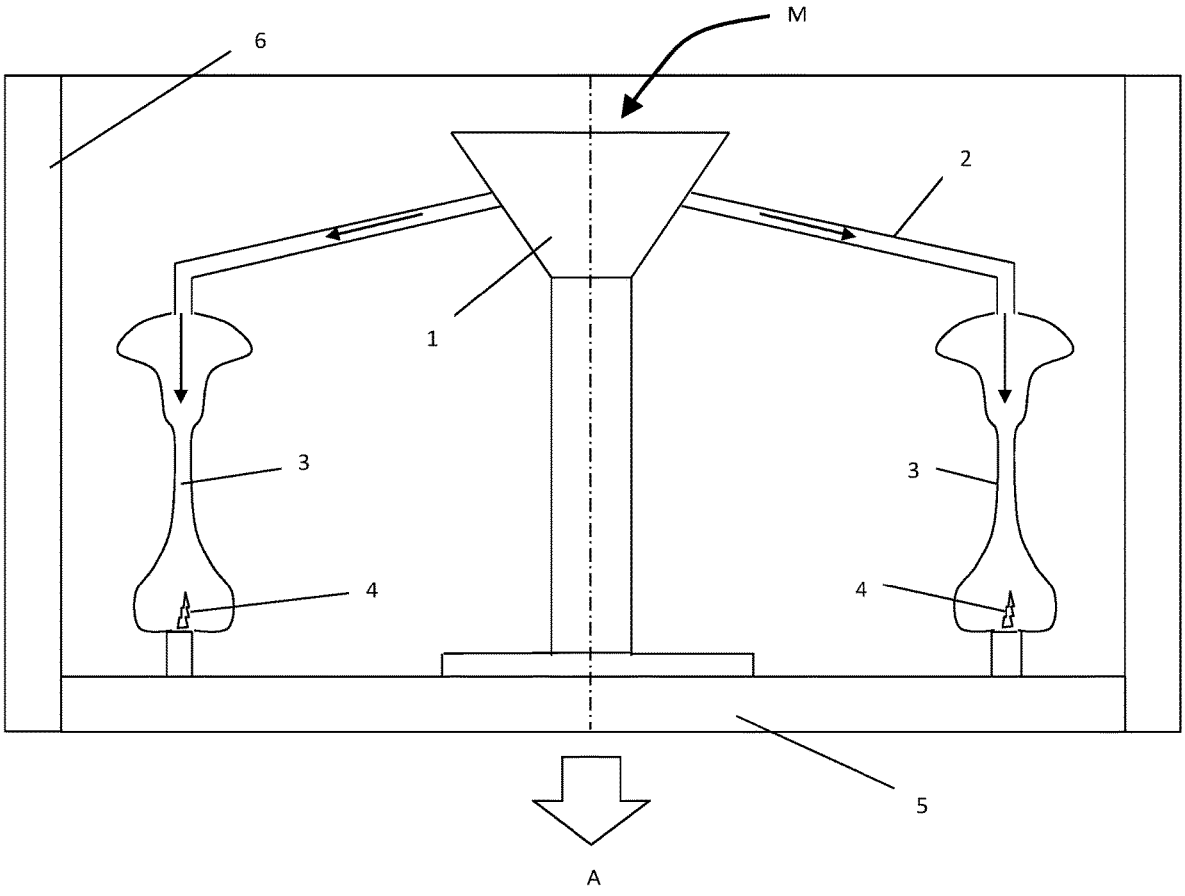
FIG. 1 shows in schematic a known apparatus for the simultaneous manufacture of multiple cast components using a directional solidification process.

FIG. 1 has been described in more detail above. In the arrangement of FIG. 1 it will be noted that a substantial void space exists between the moulds 3 and a central support column which supports the pouring cup 1. The void causes a heat sink between the support column and the moulds, which "shadow" some of the radiation from the heat source 6. As a consequence, the temperature profile from the heat source side to the pouring cup side of the mould is non-uniform. This can negatively affect the microstructure of the solidifying material and result in defects in the cast components.

Figure 2:
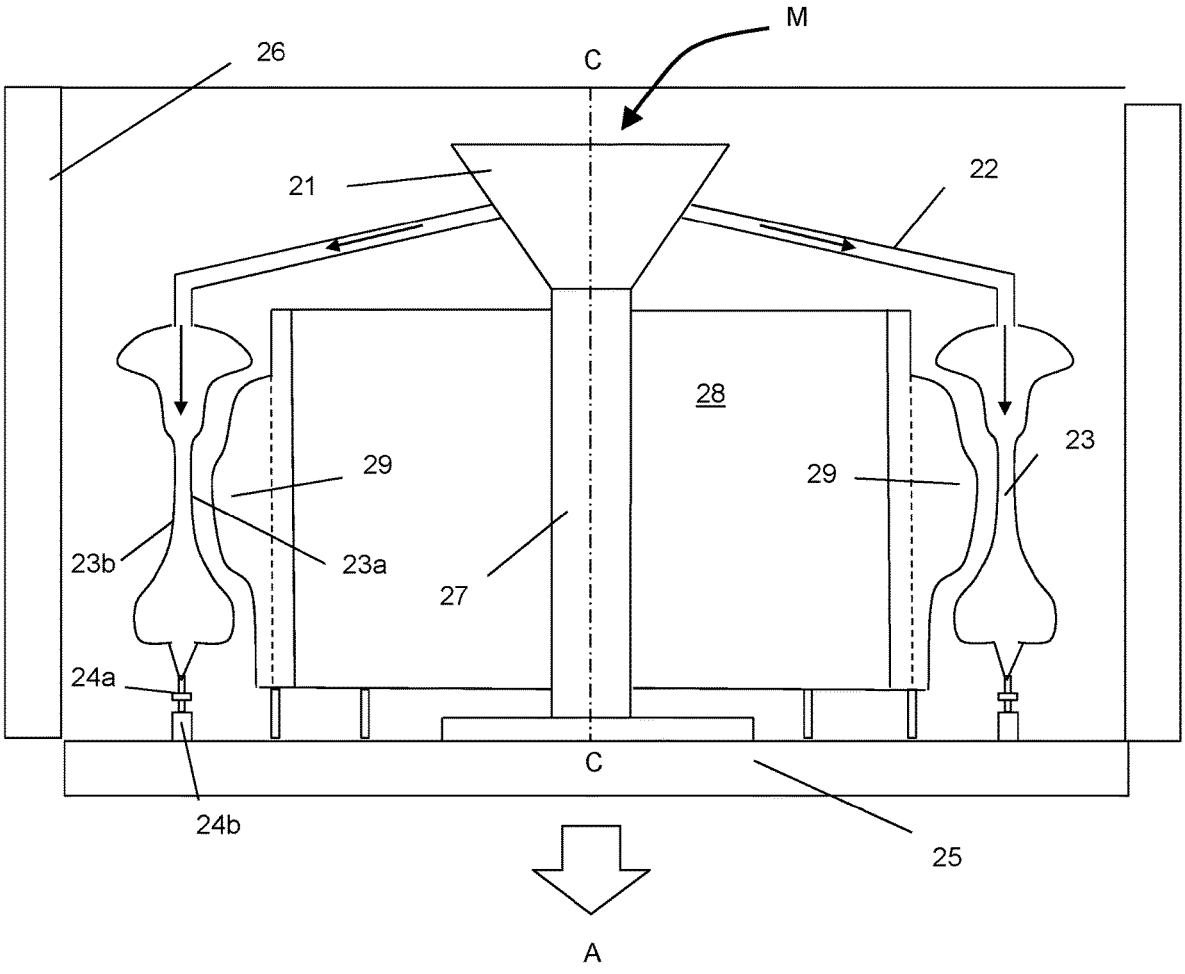
FIG. 2 shows an apparatus in accordance with an embodiment of the invention.

As can be seen in FIG. 2, an apparatus in accordance with an embodiment of the invention comprises a pouring cup 21 into which molten material M is poured. The pouring cup 21 sits on a cylindrical support column 27 having a centreline C-C. A plurality of feed channels 22 extend radially around the centrally arranged cup 21 to a top end of the moulds 23. Molten material M poured into the cup 21 flows along the feed channels 22 and into the moulds 23. Each mould 23 is provided with a grain selector 24*a* at a bottom end which terminates in a starter block 24*b*. The starter blocks 24*b* sit on a chill plate 25 which is maintained generally at a temperature below the melting point of the material M creating a temperature gradient from the bottom to the top of the moulds 23. During the pouring process, the moulds are enclosed by a heat source 26 which encircles the cup 21 and mould 23 assembly. The assembly is drawn in a controlled manner out of the heat source in the direction of arrow A to ensure directional solidification from the bottom of the moulds 23 to the top of the moulds 23. The combination of the grain selector and starter with controlled cooling encourages growth of a single crystal structure in the solidifying casting. As an alternative to the grain selector and starter block, a seed crystal might be included in the mould in the same manner as described for the apparatus of FIG. 1.

A circumferential wall 28 is arranged to encircle the support column 27 and sits close to and in thermal contact with the moulds 23, the wall 28 includes three dimensional profiled local deflectors 29 which are profiled to follow a facing contour of the moulds 23. The local deflectors 23 are shown as integrally formed with the wall 28 but may comprise separate components which can be secured to the wall 28. The construction of the wall 28 and local deflectors 29 is such as to deflect heat emitted from the heat source 26 back towards a facing surface 23*a* of the moulds 23 which surfaces 23*a* would otherwise be shadowed from radiative heat travelling towards the central support column 27. This prevents a thermal gradient developing from the heat source side 23*b* to the support column side 23*a* of the moulds 23.

Whilst the Figures illustrate a centrally arranged pouring cup, radially extending feed channels and a substantially circular array of moulds about the cup, the skilled addressee will understand that such an arrangement is not essential to the practising of the invention. The location of the source of molten fluid and the path taken from the source to the moulds does not impact on operation of the invention.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. An apparatus for the simultaneous casting of multiple components using a directional solidification process comprising:

a support column;

a pouring cup resting directly on the support column;

an array of moulds including grain selector cavities at bottom ends of the moulds to assist in the initiation of single crystal formation within the moulds;

a chill plate arranged at a bottom end of the array of moulds;

a starter disposed on the chill plate;

an array of feed channels extending from the pouring cup to each mould; and a heat deflector, wherein the apparatus is configured to be controllably cooled by withdrawal from a heat source surrounding the array of moulds in a direction opposite to a desired direction of solidification once the moulds have been filled, the heat deflector comprises a wall arranged to encircle the support column and on an opposite side of the array of moulds to the heat source, the wall extending lengthwise along the moulds and in thermal contact with the moulds, and a surface of the wall facing the moulds includes an array of local deflectors which are each shaped to follow the contour of a mould to which they are positioned adjacent and axially offset with respect to the mould based on a thermal behavior of a material in the mould, and the array of local deflectors are positioned such that the surface of the wall facing the moulds is axially offset at least at one point on one side of a radial inflection point on the surface of the wall and at another point on another side of the radial inflection point.

2. The apparatus as claimed in claim 1, wherein the array of moulds is circular and the wall is a circumferential wall.

3. The apparatus as claimed in claim 1, wherein the wall is multi-faceted.

4. The apparatus as claimed in claim 1, wherein the wall is modular.

5. The apparatus as claimed in claim 1, wherein the local deflectors are removably secured to the wall.

6. The apparatus as claimed in claim 1, wherein the local deflectors are integrally formed with the wall.

7. The apparatus as claimed in claim 1, wherein the wall and/or local deflectors are formed from a wax core surrounded by a high temperature capable material.

8. The apparatus as claimed in claim 7, wherein the high temperature capable material is selected from: a ceramic, carbon or graphite.

9. The apparatus as claimed in claim 1, wherein the wall and/or local deflectors are provided with a high emissive surface coating.

10. The apparatus as claimed in claim 9, wherein the surface coating is a magnesium oxide paint, an aluminium oxide paint or a titanium oxide paint.

11. The apparatus as claimed in claim 1, wherein the moulds define the shape of turbine blades.

12. The apparatus as claimed in claim 1, wherein the moulds define the shape of nozzle guide vanes, compressor blades or seal segments configured for use in a gas turbine engine.

13. The apparatus as claimed in claim 1, wherein the grain selector, the starter, and the controlled cooling together encourage growth of a single crystal structure in the material of the mould.

* * * * *